US008747004B1

(12) United States Patent
McPherson et al.

(10) Patent No.: US 8,747,004 B1
(45) Date of Patent: Jun. 10, 2014

(54) DUAL DIAMETER CAP WITH INTEGRAL AND ADJUSTABLE SWAB

(71) Applicant: IPS Corporation, Durham, NC (US)

(72) Inventors: Terry R. McPherson, Mebane, NC (US); Jack D. Roach, Durham, NC (US); Steven R Cole, Collierville, TN (US)

(73) Assignee: IPS Corporation, Durham, NC (US)

( * ) Notice: Subject to any disclaimer, the term of this patent is extended or adjusted under 35 U.S.C. 154(b) by 0 days.

(21) Appl. No.: 13/855,799

(22) Filed: Apr. 3, 2013

(51) Int. Cl.
*A46B 11/00* (2006.01)

(52) U.S. Cl.
USPC ..... 401/130; 401/126; 401/127; 215/319

(58) Field of Classification Search
USPC ..... 401/126–130; 215/319, 321
See application file for complete search history.

(56) References Cited

U.S. PATENT DOCUMENTS

| | | | | |
|---|---|---|---|---|
| 4,990,014 | A * | 2/1991 | O'Neill | 401/127 |
| 6,309,125 | B1 * | 10/2001 | Peters | 401/127 |
| 6,877,626 | B2 * | 4/2005 | Sherrod | 215/319 |
| 7,857,172 | B2 * | 12/2010 | Harvey | 222/321.1 |

* cited by examiner

*Primary Examiner* — David Walczak
(74) *Attorney, Agent, or Firm* — Ralph H. Dougherty

(57) ABSTRACT

An improved device for use as a lid with integral handle for attachment to a can, the lid portion having two concentric sets of threads to engage a container having one of two spout diameters, an applicator or swab being adapted to extend from the handle in which it is situated, the extension distance of the swab being adjustable within the handle, the swab being useful as an applicator for applying liquid coatings, solvents, adhesives, or other materials. The invention also includes a variety of attachments for use with the lid and handle.

11 Claims, 8 Drawing Sheets

Fig. 12
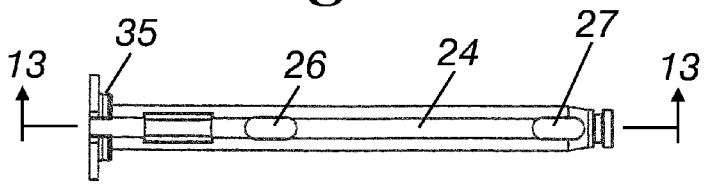
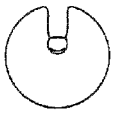
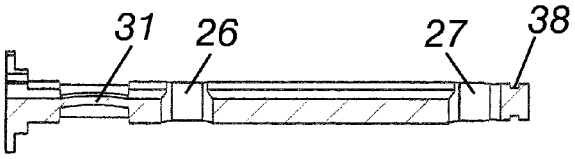
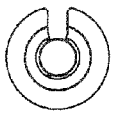
Fig. 14 Fig. 13 Fig. 15
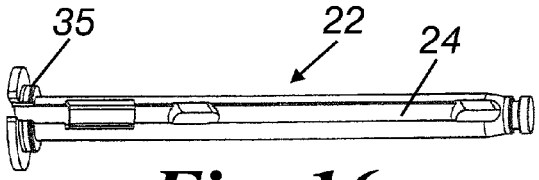
Fig. 16
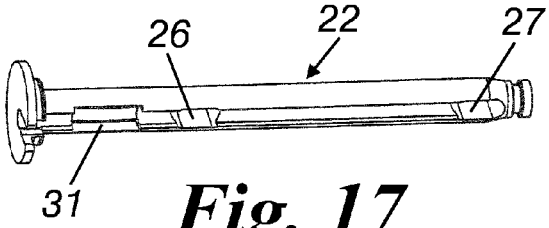
Fig. 17

DUAL DIAMETER CAP WITH INTEGRAL AND ADJUSTABLE SWAB

FIELD OF THE INVENTION

The present invention relates to an applicator apparatus and accessories for applying liquid coatings solvents, adhesives, or other materials to a substrate and more particularly to a dual diameter cap having an integral and adjustable swab therein for use with a quart, gallon, or other capacity container of such liquid coatings solvents, adhesives, or other materials.

BACKGROUND OF THE INVENTION

Applicators for applying various materials to a substrate, such as liquid coatings, solvents, adhesives, or other materials, are well known, including applicators which are incorporated into the cover or lid of a jar or other container, as the applicator brush incorporated into the lid of a glue or rubber cement jar. Such applicators, however, are limited in their use, as the glue brush usually doesn't quite reach the bottom of the container, and the lid to which it is attached fits only on a single diameter container opening, and does not fit onto a container with a different diameter opening. Also, when a separate applicator is used to apply a coating, it must be cleaned after use and stored separately from the container, which leads to the applicator becoming grimy or gritty before a subsequent use. It is also possible that the applicator can become separated from the container, misplaced or lost, which requires the operator additional time to locate it. Coatings commonly are packaged in cans, normally one quart or one gallon, or similar variations. Such cans are provided with an opening, neck, or spout. It is desirable that a lid be provided to a manufacturer that can be used on the two most popular sizes of cans, and that are interchangeable between the can spout diameters of such cans. Thus, there is a need for an applicator that can be extended to reach the lowermost portion of a container, that is integral with the container lid, and will fit more than one diameter of container opening.

SUMMARY OF THE INVENTION

The invention provides apparatus for acting as a cover, lid, or cap, for a container, and as an applicator for a liquid material onto a substrate. A lid with an integral handle is provided for attachment to a can or other container opening. The lid portion has two concentric sets of threads to engage a container having one of two spout diameters. An applicator or swab is adapted to extend from the handle in which it is situated, the extension distance of the swab being adjustable within the handle. The swab is used as an applicator for applying liquid coatings, solvents, adhesives, or other materials onto a surface or substrate.

The invented cover is placed on a container containing a liquid to be applied to a substrate. During use, the cover is removed from the container, and the swab is adjusted as necessary to the desired extension, then dipped into the container to obtain the liquid, and used in a normal manner as a liquid applicator.

The present invention is particularly useful with standard quart and gallon cans of adhesives, coatings, or solvents.

OBJECTS OF THE INVENTION

The principal object of the present invention is to provide an improved lid, cover, or cap having the capability of fitting containers having different diameter openings.

Another object of this invention is to provide a container lid having an integral applicator or swab for applying a coating to a surface.

Another object of the invention is to provide applicator apparatus for reaching the full depth of a container having a coating material therein.

Another object of this invention is to provide an applicator apparatus having an adjustable length.

A further object of this invention it to provide an applicator apparatus having a plastic pipe cutting capability.

BRIEF DESCRIPTION OF THE DRAWINGS

The foregoing and other objects will become more readily apparent by referring to the following detailed description and the appended drawings in which:

FIG. 12 is a top view of a shank retainer.

FIG. 13 is a sectional view of the shank retainer of FIG. 12 taken along the lines 13-13 of FIG. 12.

FIG. 14 is a left end view of the shank retainer of FIG. 12.

FIG. 15 is a right end view of the shank retainer of FIG. 12.

FIG. 16 is a right hand isometric view of the shank retainer of FIG. 12.

FIG. 17 is a left hand isometric view of the shank retainer of FIG. 12.

DETAILED DESCRIPTION

Figure 1:
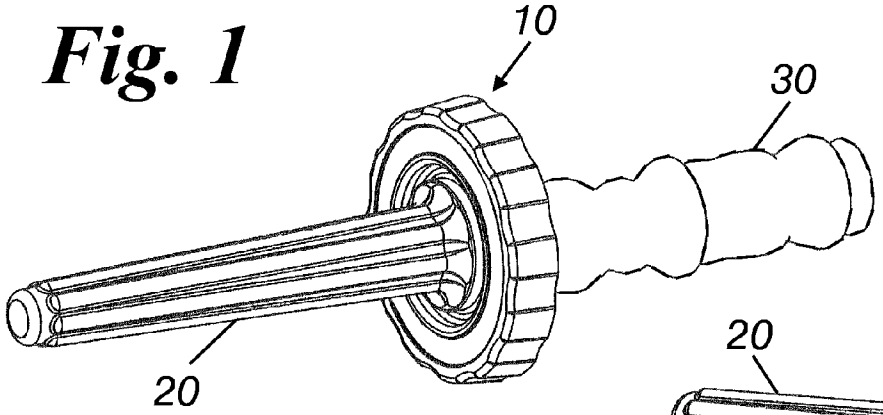
FIG. 1 is a perspective view of the invented dual diameter cap with integral and adjustable swab taken from the upper end of the cap.
Figure 2:
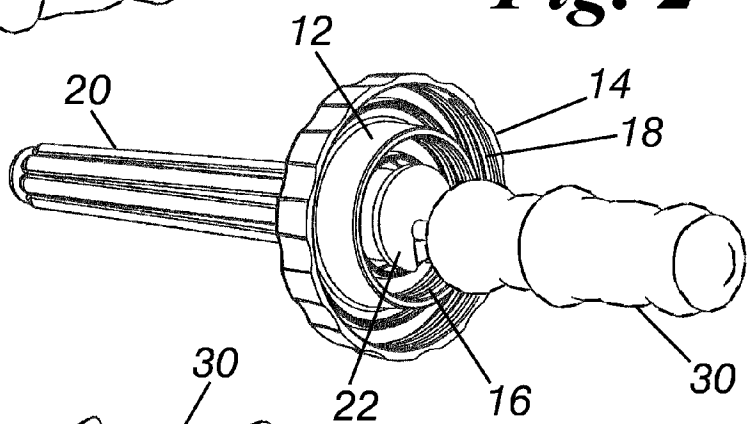
FIG. 2 is a perspective view of the invented cap showing the underside thereof.
Figure 3:
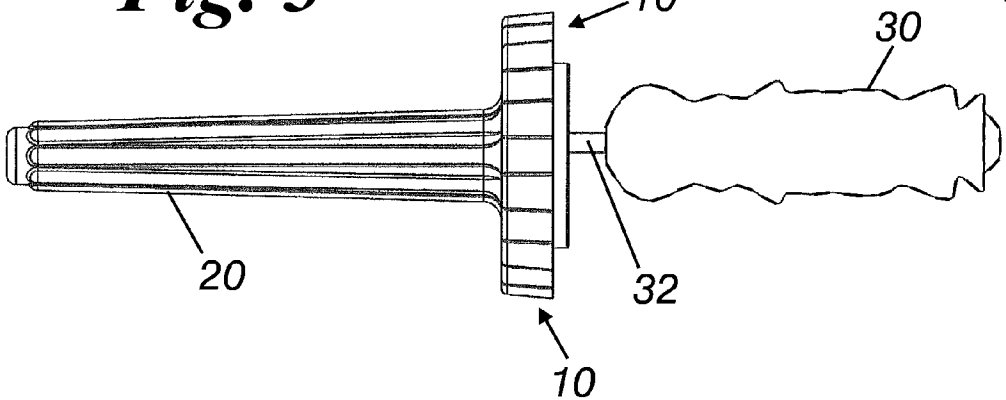
FIG. 3 is a right side view of the invented cap, the top and bottom views being the same, the left side view being a mirror image thereof.
Figure 4:
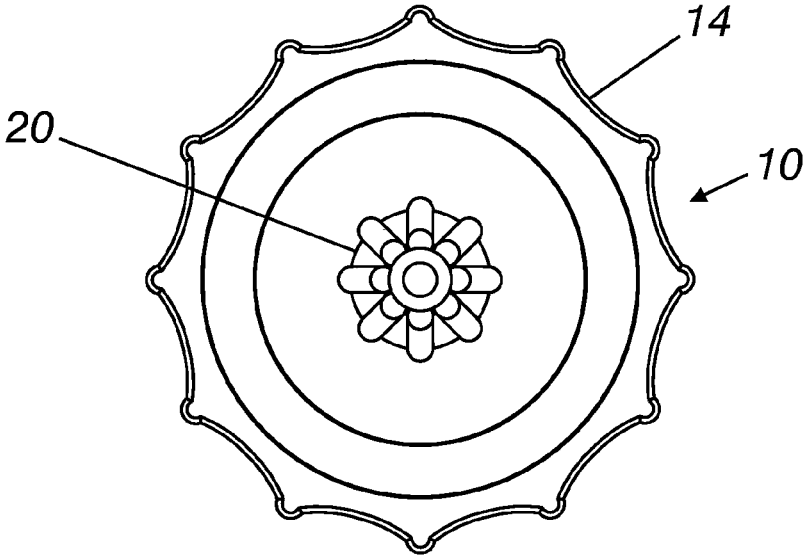
FIG. 4 is a left end view of FIG. 3.
Figure 7:
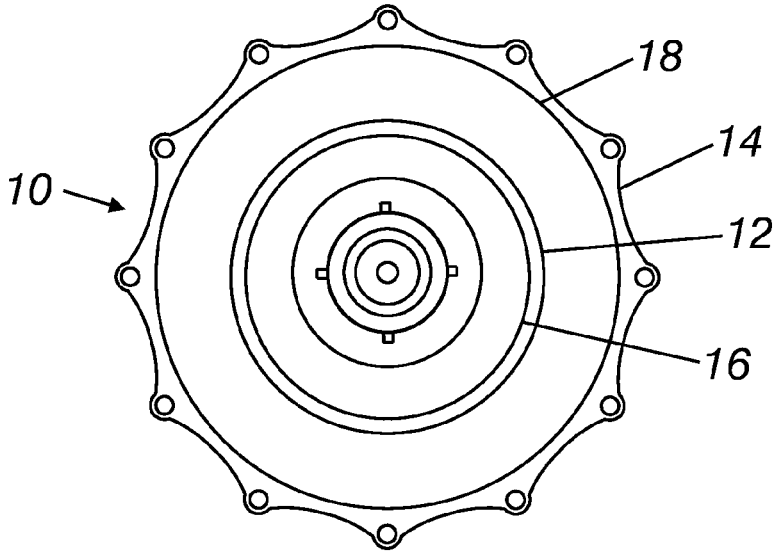
FIG. 7 is a right end view of FIG. 3, with the swab removed.
Figure 5:
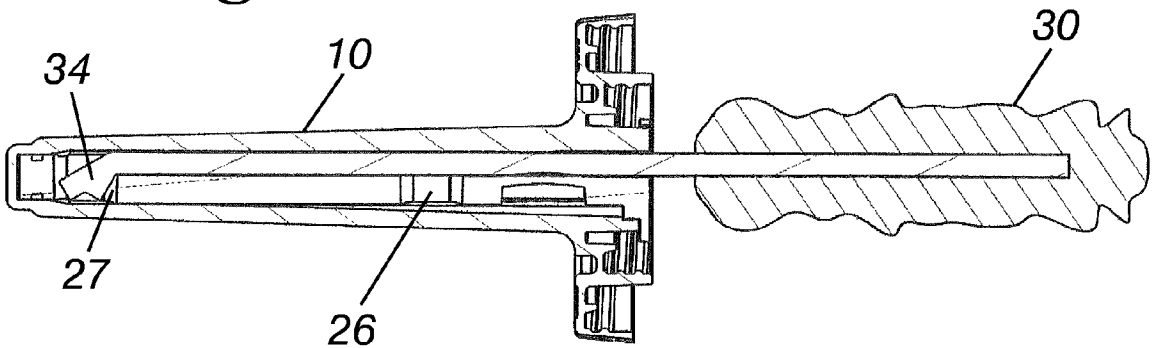
FIG. 5 is a longitudinal cut away view taken along the centerline of FIG. 3 with the swab in a retracted position.
Figure 6:
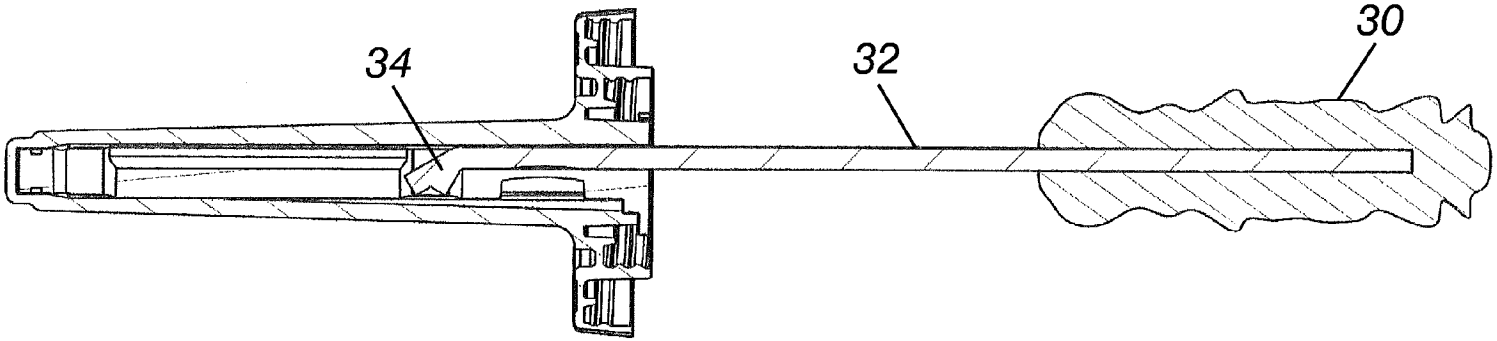
FIG. 6 is a longitudinal cut away view taken along the centerline of FIG. 3, but with the swab portion in an extended position.
Figure 8:
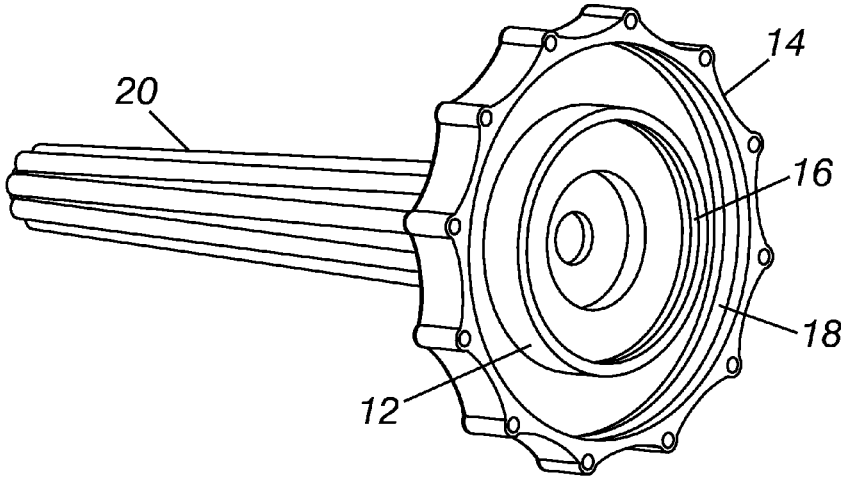
FIG. 8 is a perspective view of the invented cap with the swab removed.
Figure 9:
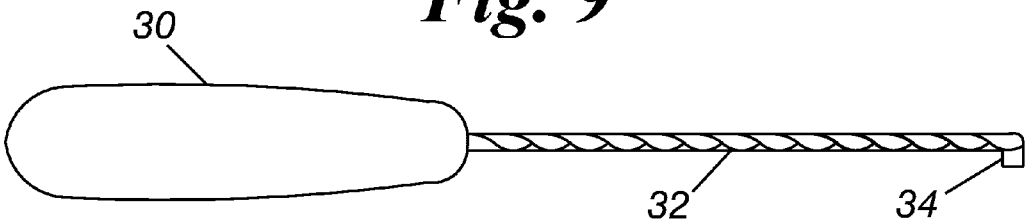
FIG. 9 is a side view of a removed swab.
Figure 10:
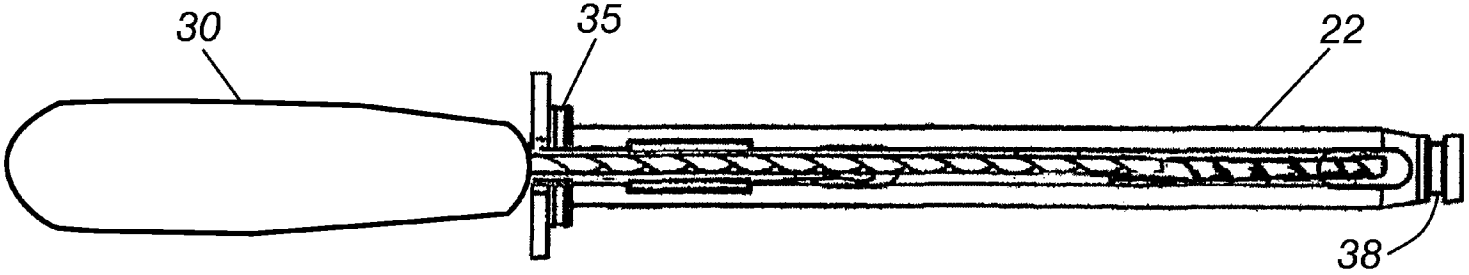
FIG. 10 is a side view of a swab shank holder with a swab engaged in a first position in the swab holder for insertion into the handle portion of the cap.

Referring now to the drawings, a lid 10 has a tubular inner member 12 and a concentric tubular outer member 14, provided with concentric sets of internal threads 16 and 18 respectively. The threads are adapted to engage a container having one of two externally threaded neck or spout diameters. Generally, there are two common spout diameters, one for a gallon can and one for a quart can. The invented dual concentrically threaded container cap is preferably adapted to fit these two standard diameter container spouts. The outer tubular member 14 of the lid containing the outer threads 18 has a slightly shorter tube length than the inner tubular member 12, to allow clearance for a can edge or rim.

Figure 11:
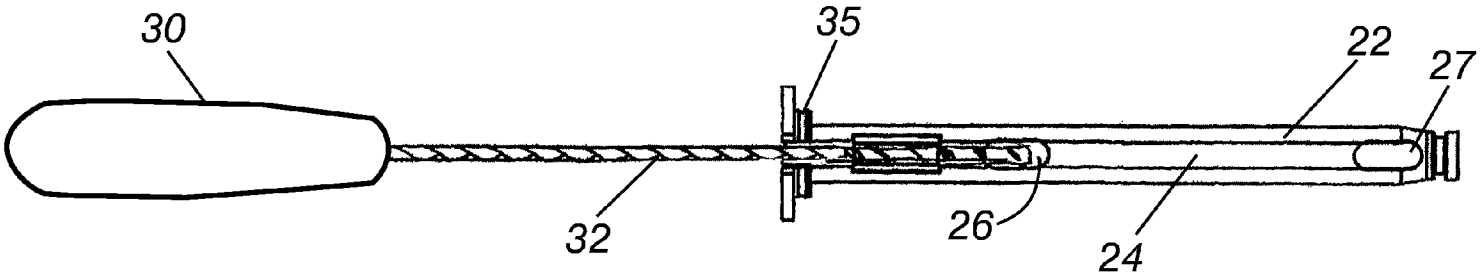
FIG. 11 is a side view of the swab shank holder engaged in a second position in the holder for insertion into the handle of the cap.

Lid 10 is provided with a handle 20, which has a hollow interior. The lid 10 and handle 20 are unitary and preferably made of molded plastic. A swab holder 22 is adapted for insertion into the hollow handle 20. In the embodiment shown in FIGS. 11 and 12, the holder has a groove 24 on one side and lateral holes 26, 27, therethrough. Any desired number of holes may be provided, but usually two or three holes are sufficient, although the invention contemplates 2 such holes as shown in FIGS. 12 and 17.

A brush or swab 30 has a wire or plastic shank 32, with a shank hook 34 at one end adapted to engage any hole selected by the user in the holder 22. When the shank hook 34 is inserted into a hole or recess in the shank holder 22 with the shank situated at least partially within the handle 20, and the shank 32 is fully seated within the handle 20, the swab 30 extends the desired length outwardly (usually downwardly) from the handle 20, which may then be used as an applicator handle for manipulating the brush or swab 30 to apply a liquid to a substrate.

Figure 24:
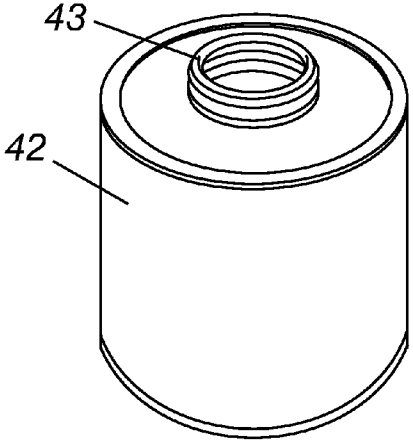
FIG. 24 is a perspective view of a quart container with which the invention is used.
Figure 25:
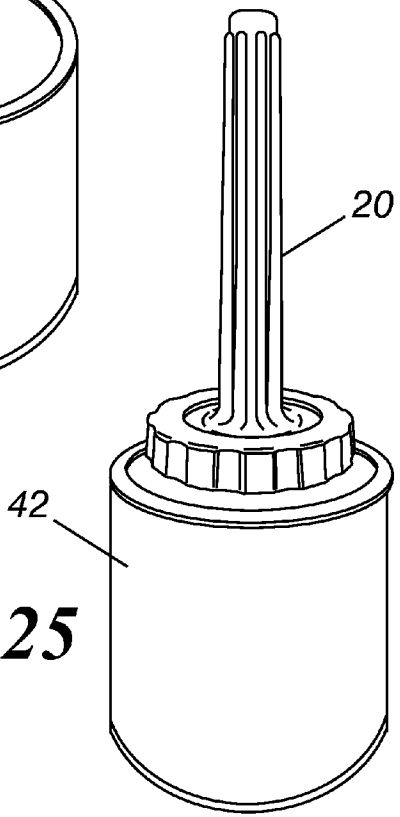
FIG. 25 is a perspective view of a quart container with the invented lid thereon.
Figure 23:
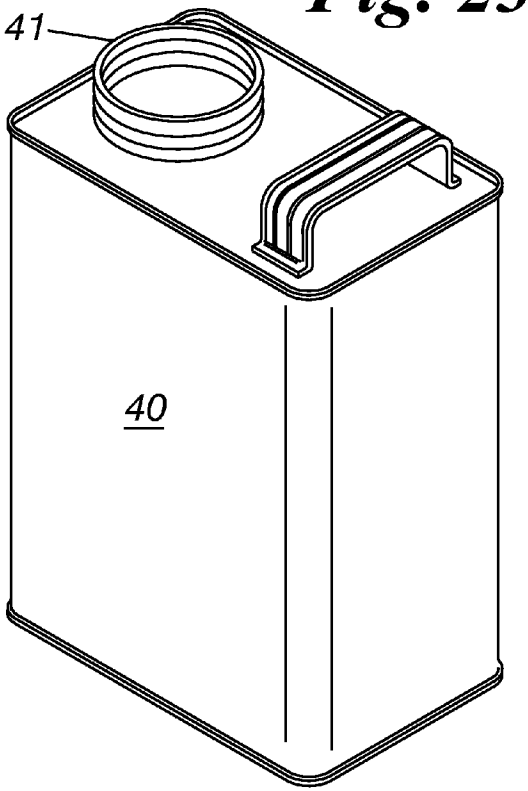
FIG. 23 is a perspective view of a gallon container with which the invention is used.

The threaded lid 10 is adapted to engage either of the two standard-size cans containing a material to be applied by the applicator swab. Gallon can 40 with threaded spout 41 is shown in FIG. 23, while quart can 42 with threaded spout 43 is shown in FIG. 24. A locking mechanism 35 is provided by which the handle 20 retains the swab in position with relation to the handle during use as an applicator. This is a removable press fit. The shank holder 22 incorporates a molded-in spring 31, the resilience of which automatically adjusts to variations in shank diameters. Wire or plastic shank diameters may vary. The molded-in spring accommodates a wide variety of shank diameter tolerances, and holds the wire or plastic shank tightly against the interior of the lid handle 20 when the shank holder is inserted into its desired position.

In use, the lid 10 is placed onto a can or bottle containing the liquid to be applied, on in which the liquid is stored. Before use, the applicator swab 30 is normally in the closest position near the lid. In operation, the lid is removed from the container, and depending on container size, the user selects the appropriate swab position on shank holder 22 and inserts the shank hook 34 into the selected hole 26 or 27. Shank 32 is then pressed into groove 24. Shank holder or shank retainer 22 containing shank 32 is inserted into the hollow of handle 20 and locking mechanism 35 is engaged by a hand-tight press fit. The elongated shank retainer 22 may be removed from the handle 20 along with the swab 30, and the shank hook 34 relocated into a desired hole in the shank retainer 22 to change to a different extension orientation. In the extended position, the swab is used as an applicator which will reach deeply into the container to obtain the liquid to be applied to a substrate. After use, the swab can be re-situated, or it can be left in the position of use, or it can be removed for cleaning and storage, and the lid replaced on the threaded spout of the container.

Alternative Embodiments

Alternatively, shank retainer 22 may be held in the handle 20 by a press fit 35, or by an o-ring situated in a groove on the retainer and which engages the interior wall of the handle 20.

Figure 18:
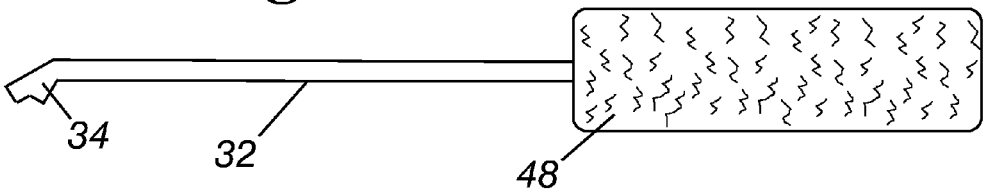
FIG. 18 is a side view of a roller applicator accessory for use with the invention.
Figure 19:
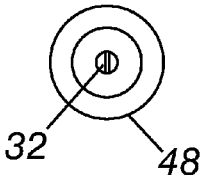
FIG. 19 is an end view of a the roller applicator accessory of FIG. 18 for use with the invention.
Figure 20:
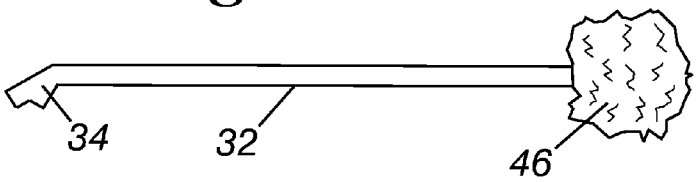
FIG. 20 is a side view of a dauber applicator accessory for use with the invention.
Figure 21:
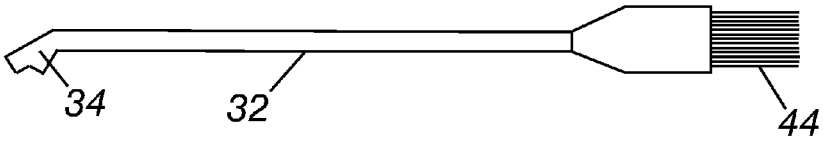
FIG. 21 is a side view of a brush applicator accessory for use with the invention.

The swab 30 may be any desired type of applicator, including a brush 44 as shown in FIG. 21, a dauber 46 of solid or soft applicator material such as plastic foam, cotton or other useful material as shown in FIG. 20, or a roller 48 , as shown in FIGS. 18 and 19, which is journaled for rotation about the applicator shank 32.

Figure 22:
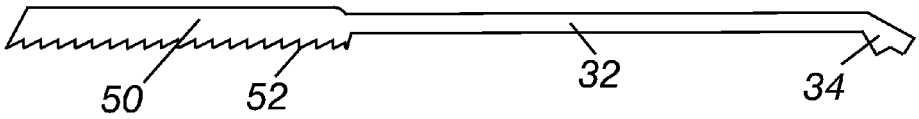
FIG. 22 is a side view of a saw blade attachment accessory for use with the invention.

A saw blade 50, as shown in FIG. 22 may be substituted for the swab for the purpose of cutting plastic pipe. The saw blade is molded in place and just slides into the handle. Alternatively, it may be provided with a hook for engagement with any of the lateral holes 26, 27, in the shank holder 22. The blade teeth 52 are oriented to cut only on a forward thrust so the cutting action will not pull the blade out of the holder as it would if the blade were allowed in cut on a reverse stroke where the teeth would be held by the pipe and create a force to remove the blade 50 from the handle 20.

Summary of the Achievement of the Objects of the Invention

From the foregoing, it is readily apparent that we have invented an improved lid or cap having the capability of fitting containers having different diameter openings, a container lid having an integral applicator or swab for applying a coating to a surface, the applicator being adjustable in length for reaching the full depth of a container having a coating material therein.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A lid for attachment to a container having a threaded spout, said lid comprising:

an elongated handle having a hollow interior and open at one end;

a pair of concentric tubular spout engagement portions incorporated into said handle, each of which is provided with internal threads;

wherein the concentric spout engagement portions are inner and outer spout engagement portions, and said outer spout engagement portion is shorter than said inner spout engagement portion such that a lower edge of said inner spout engagement portion extends beyond a lower edge of said outer spout engagement portion by a sufficient dimension to provide clearance for a container rim.

2. A lid according to claim 1 which is unitary molded plastic.

3. A lid according to claim 1, further comprising a swab holder insertable into said handle, and a swab attachable to said swab holder.

4. A lid according to claim 3, wherein said swab is selected from the group consisting of: a brush, roller, foam applicator, or dauber.

5. A lid according to claim 3, wherein said swab holder is retainable in said handle by a press fit.

6. A lid according to claim 1, further comprising a saw blade and means for removably fixing said saw blade within said handle, said means including a saw blade retainer having receiving holes, and said saw blade being removably fixable onto said saw blade retainer, and said saw blade retainer being adjustable and retainable in said handle.

7. Apparatus according to claim 6, wherein said saw blade is so arranged on said saw retainer that the teeth of the blade cut only on the push stroke.

8. Apparatus for applying a coating to a substrate, comprising:

a lid having an integral handle for attachment to a can with a threaded spout, said lid having concentric inner and outer tubular spout engagement portions incorporated into said handle, each of which inner and outer spout engagement portion is provided with internal threads to engage a container spout having one of two spout diameters;

said outer spout engagement portion being shorter than said inner spout engagement portion such that a lower edge of said inner spout engagement portion extends beyond a lower edge of said outer spout engagement portion by a sufficient dimension to provide clearance for a can rim;

an applicator or swab removably mounted on an integral shank adapted to be situated in and extend from said handle in which it is situated, the extension distance of the shank and the swab being adjustable within the handle;

said swab being useful as an applicator for applying liquid coatings, solvents, adhesives, or other liquid materials.

9. Apparatus according to claim 8, wherein said applicator is attached to an elongated shank having a hook at the end opposite the applicator,, an elongated shank retainer is provided with at least two spaced holes or recesses therein for receiving said hook, and said shank retainer is further provided with an elongated groove for situating at least a portion of said shank therein.

10. Apparatus according to claim 9, wherein said applicator is selected from the group consisting of a brush, roller, foam swab, or dauber.

11. Apparatus according to claim 10 wherein said applicator is a roller journaled for rotation about said shank.

* * * * *